United States Patent [19]

Dovman

[11] 4,144,674

[45] Mar. 20, 1979

[54] WINDOW CONSTRUCTION

[76] Inventor: Nathan Dovman, 6713 Akron St., Philadelphia, Pa. 19148

[21] Appl. No.: 865,531

[22] Filed: Dec. 29, 1977

[51] Int. Cl.[2] ..... E05D 15/22

[52] U.S. Cl. ..... 49/417; 49/181; 49/175; 49/421

[58] Field of Search ..... 49/421, 181, 501, 172, 49/174, 175, 176, 183, 184, 185, 186, 407, 414, 417, 423, 434, 454, 455

[56] References Cited

U.S. PATENT DOCUMENTS

| | | | |
|---|---|---|---|
| 599,230 | 2/1898 | Frotscher | 49/175 |
| 1,487,199 | 3/1924 | Bradner | 49/172 |
| 2,024,877 | 12/1935 | Reynolds | 49/181 X |
| 3,103,711 | 9/1963 | Teggelaar | 49/418 X |
| 3,859,754 | 1/1975 | Budich et al. | 49/501 X |

FOREIGN PATENT DOCUMENTS

| | | | |
|---|---|---|---|
| 2253387 | 6/1975 | France | 49/181 |

*Primary Examiner*—Kenneth Downey
*Attorney, Agent, or Firm*—Edelson and Udell

[57] ABSTRACT

A window construction comprising a master frame and a pair of glazed window sashes which are double-hung in the window frame for normal operation and are provided with means to permit inward tilting of the sashes for cleaning and servicing of the same as may be required. The master window frame and both of the sashes mounted therein are each formed of an assembly of sections having the same hollow cross-sectional shape throughout the lengths thereof to provide not only the master frame but also each sash with a perimetrally continuous plenum of confined air which effectively serves as a thermal insulating barrier. Each of the window sashes is fitted on its opposite side edges with hollow thermal insulating spring-pressed weatherstripping members which respectively resiliently engage and made weather-tight contact with vertically extending runways provided therefor in the opposite side rail members of the master frame.

The window frame is provided in its opposite sides with vertically extending spring-pressed parting strips which project internally of the window frame into positions intervening the sashes when the same are in their normal double-hung condition and are adapted to be pressed outwardly from their said sash-intervening position against the restraining bias of their springs to completely clear the window opening for inward tilting of the outside window sash. Latching means are provided for releasably holding the window sashes in their normal positions for relative vertical movement thereof within the master frame.

By virtue of these spring pressed parting strips the master frame is adapted to receive therein a pair of window sashes which are of the same size and shape and so are interchangeable for installation as either the inside or the outside sash of the window assembly.

10 Claims, 9 Drawing Figures

FIG. 1
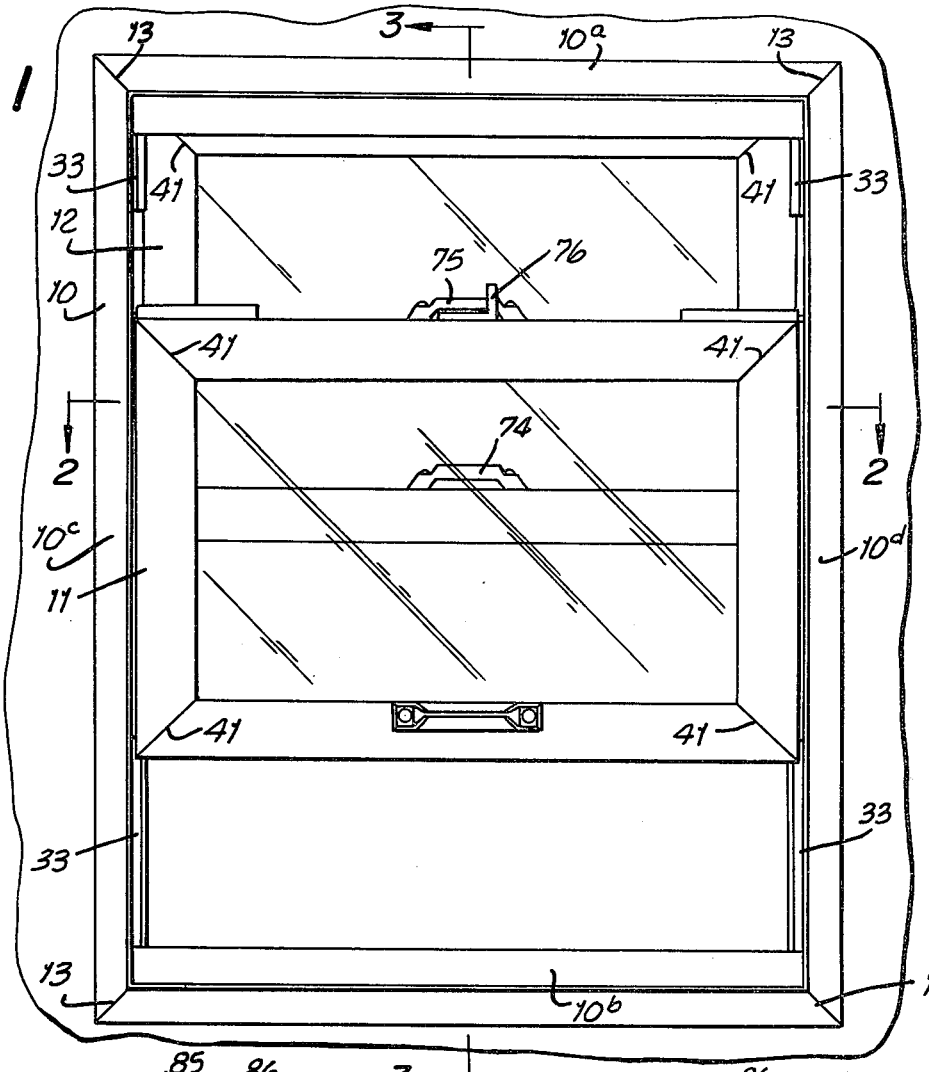
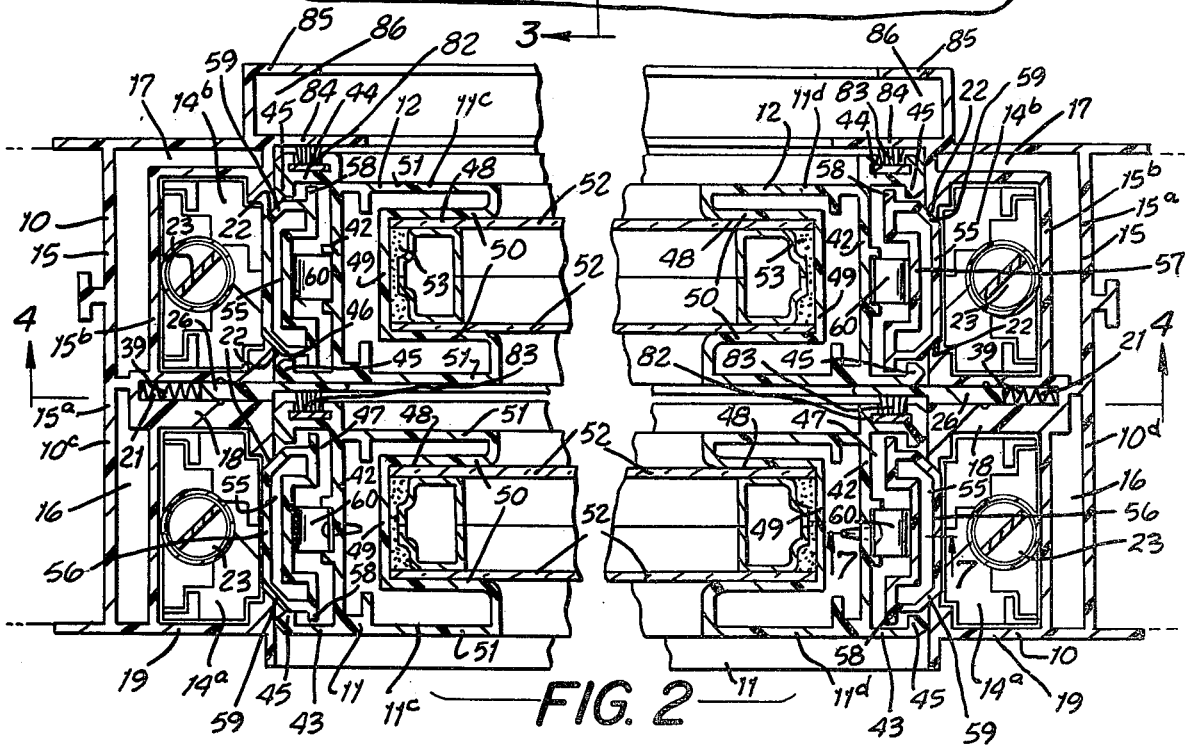
FIG. 2

FIG. 5
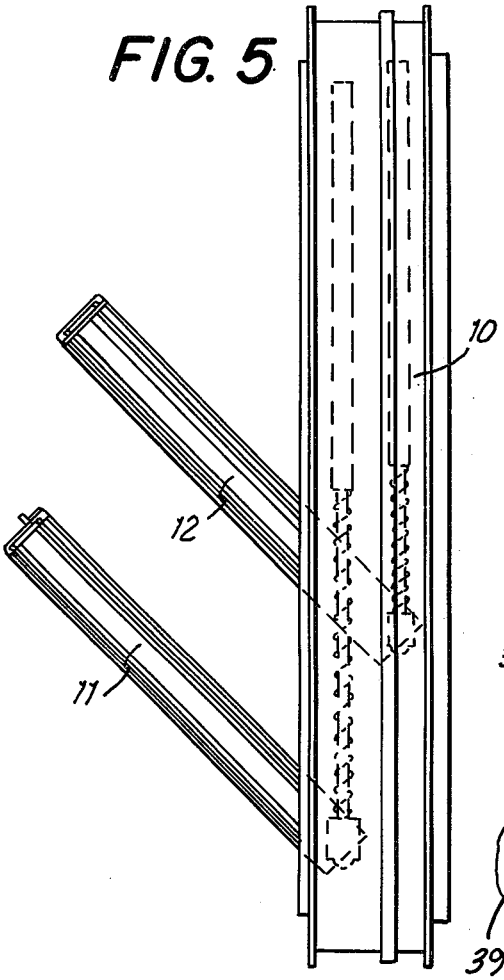
FIG. 6
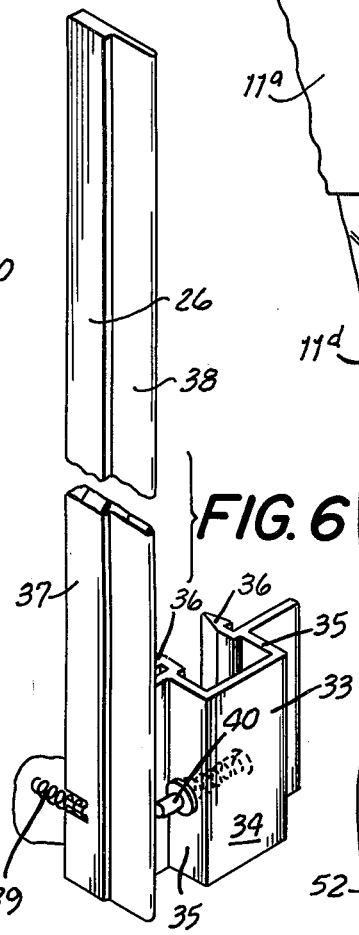
FIG. 7
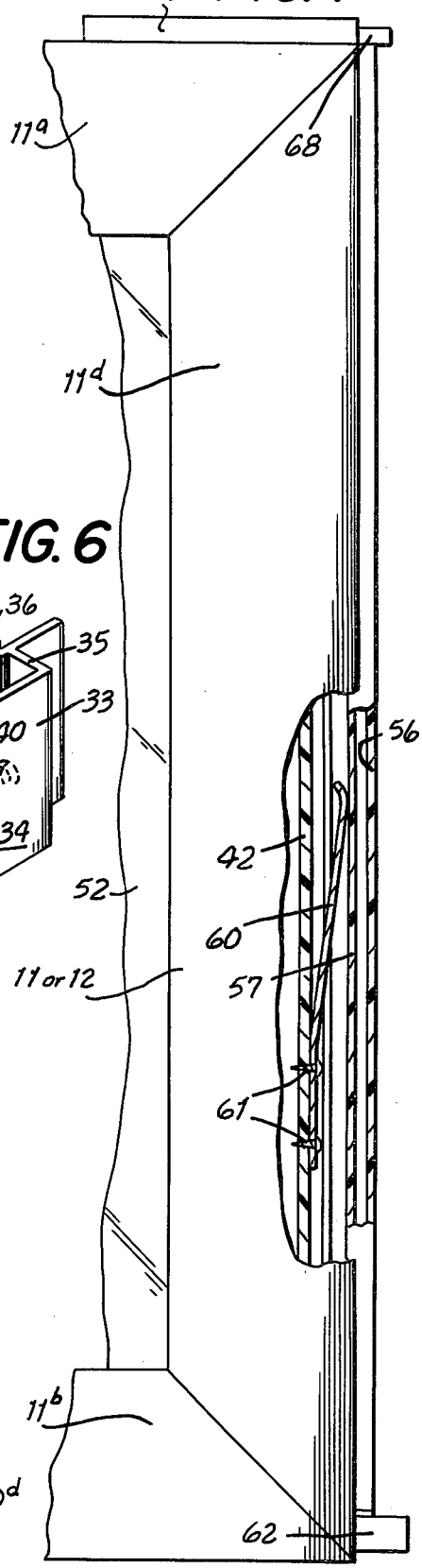
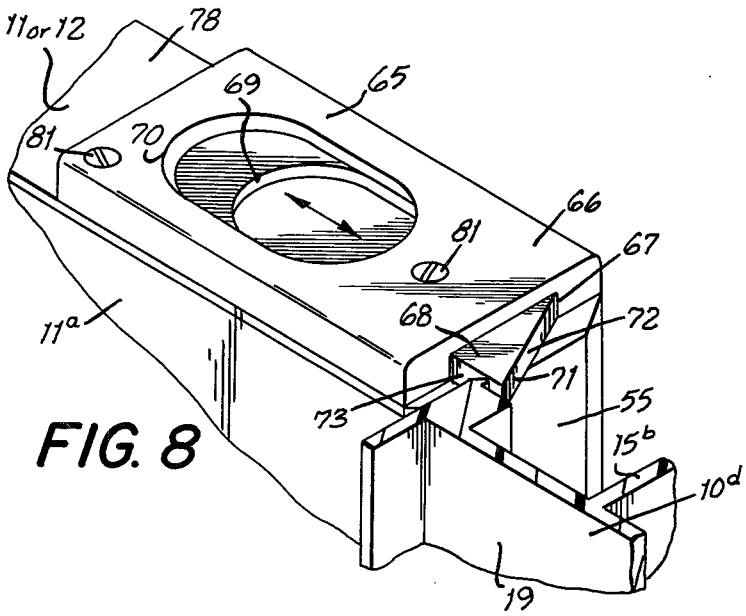
FIG. 8

WINDOW CONSTRUCTION

This invention relates generally to window constructions and more particularly to an improved construction of windows of the double-hung sash type having provision for tilting the sashes inwardly of the frame in which they are fitted to facilitate cleaning and servicing of the sashes as may be required.

Among the principal objects of the invention is the provision of a master frame for the double-hung window sash wherein the top, bottom and opposite vertical extending side rails thereof are all formed of extruded lengths of material, each being of a hollow configuration having a uniform cross-sectional shape throughout its length, which are adapted to be jointed together to provide a master window frame having a perimetrally continuous hollow internal plenum in which the air confined therein serves effectively as a thermal insulating barrier.

A further object of the invention is to similarly form the sashes mounted in the master frame of interconnected top, bottom and vertically extending side rail members, all extruded of a suitable material having a uniform cross-sectional configuration throughout their individual lengths, and wherein the opposite side rails thereof are fitted with spring-pressed members which engage the side rails of the master frame to effectively form weather-tight seals along the side edges of each of the sashes as the same move vertically within the master frame. As in the case of the master window frame, the members which form the frames of the window sashes, as well as the weather-tight seals which extend along the side edges of each sash, are also of hollow form to provide the same with a perimetrally continuous thermal insulating barriers of air.

A still further object of the present invention is to provide the master frame with a perimetrally continuous parting strip assembly in which the vertically extending sections thereof are normally biased into positions intervening the proximate side rails of the sashes when the same are disposed in their normal double-hung positions for vertical movement relatively to one another, which side sections of the parting strip are oppositely shiftable against the normal bias to which they are subjected into the interiors of the side rails of the master window frame to clear the way for inward tilting of the outside or upper window sash.

Still another and important object is to provide a window frame which is capable of having installed therein a pair of window sashes identical in construction and size which are interchangeable with one another for installation in the window frame as either the inside or outside window sash.

Still another object of the invention is to provide simple and effective retractable latch means at the top ends of each sash which are conveniently and easily accessible for operation to releasably hold the sashes in their normal double-hung relationship within the opening of the master window frame for inward tilting of the sashes as desired and which are automatically operable to snap into sash-holding positions when the tilted sashes are swung back in their normal upright positions.

Still other objects related to means provided for fully and effectively sealing all air gaps between the double-hung sashes themselves and between each sash and the master frame in which it is mounted.

Also, it is among the objects of the present invention to provide a window construction which is of an overall weight reduced to a minimum without any sacrifice in the strength and durability thereof, which is effectively and completely rendered weather-tight and which is simple and inexpensive to manufacture and install.

Other objects and advantages of the present invention will be apparent from the detailed specification which follows, it being understood that the invention consists substantially in the combination, construction, location and relative arrangement of parts, all as described more fully hereinafter, as shown in the accompanying drawings and as finally pointed out in the appended claims.

In the accompanying drawings:

FIG. 1 is a front elevational view showing the interior of a window constructed in accordance with and embodying the principles of the present invention;

FIG. 2 is a horizontal cross-sectional view of the window as taken along the line 2—2 of FIG. 1;

FIG. 5 is a side elevational view of the window showing both its glazed sashes in their inwardly tilted positions;

FIG. 6 is a perspective view showing one of the stops for limiting downward shifting of the upper sash into its position for tilting the same inwardly in association with the laterally shiftable parting strip member which normally holds the sash in its vertically shiftable condition;

FIG. 7 is a partial elevational view of one side of one of the window sashes showing in section the spring for pressing the weather-stripping member of the sash into weather-tight sealing engagement with the adjoining side of the master frame;

FIG. 8 is a perspective view of the latch device, one at each top corner of each sash, for releasably holding the sash in its normal vertically shiftable position against inward tilting thereof.

Figure 3:
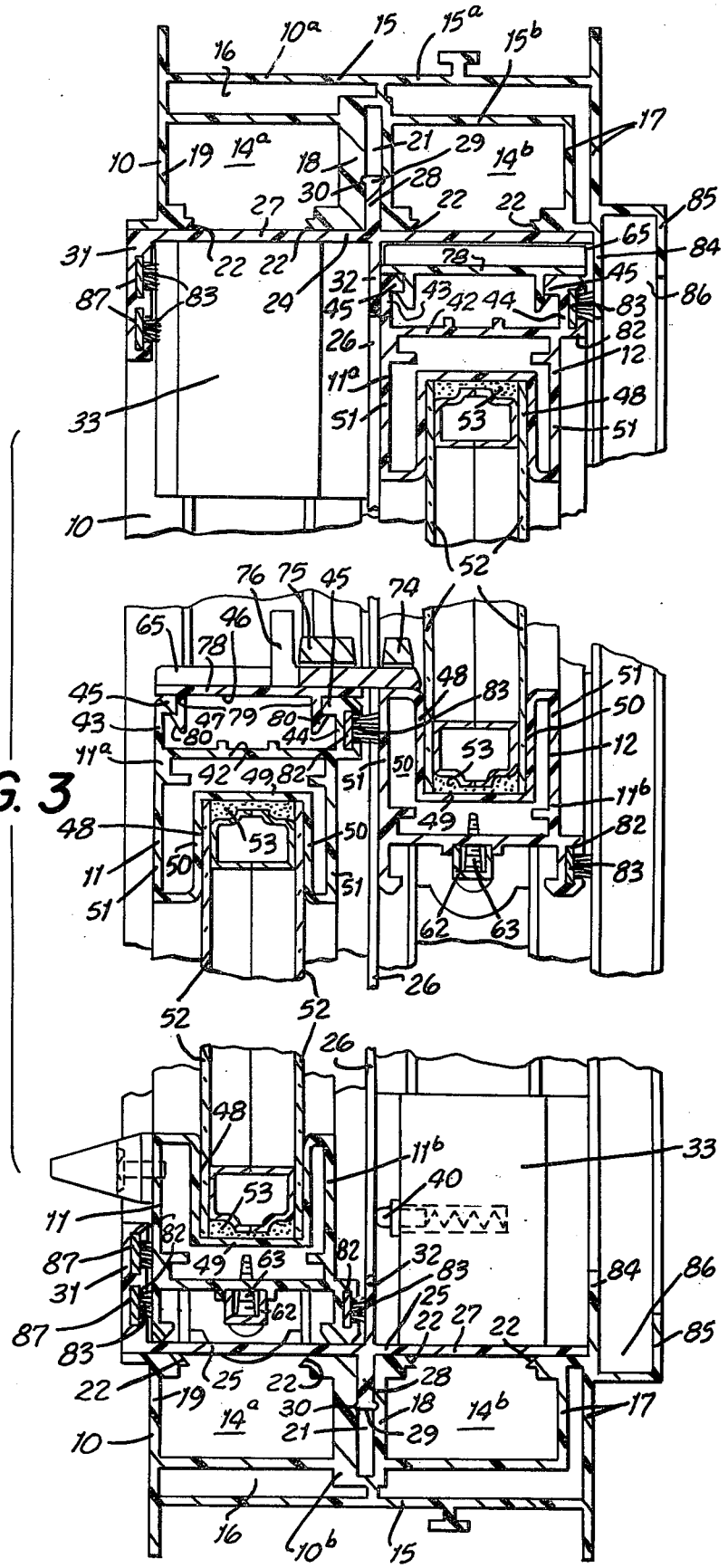
FIG. 3 is a vertical cross-sectional view of the window as taken along the line 3—3 of FIG. 1
Figure 9:
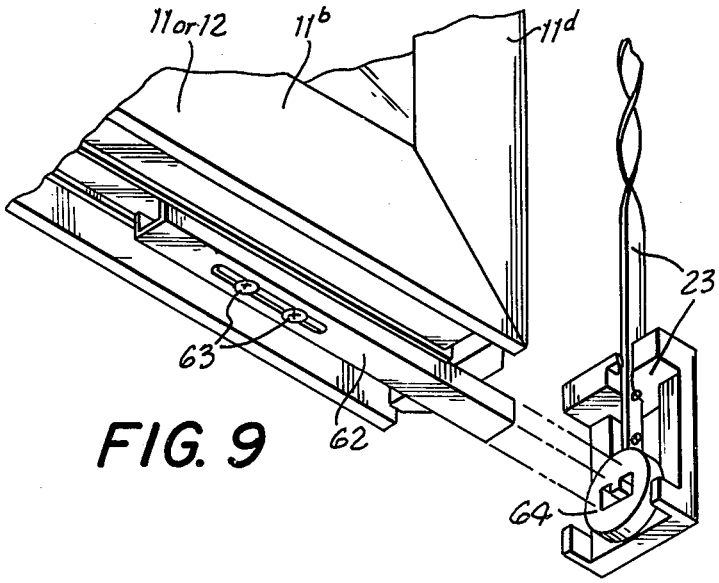
FIG. 9 is an exploded perspective view showing the manner of pivotally connecting the bottom end of one of the sashes to its associated window balance device.

Referring now to the drawings and more particularly to FIGS. 1 and 3 inclusive, it will be observed that the window as constructed in accordance with the present invention basically includes a main or master frame 10 within which is slidably fitted a pair of so-called double hung glazed sashes 11 and 12 each of which is swingable, as shown in FIG. 9, inwardly of the master frame to facilitate cleaning and other maintenance services as may be required from time to time. Both the master frame 10 and the double hung sashes 11 and 12, except for adjunct elements required for vertical sliding of the sashes within the master frame and for facilitating inward swinging of the same, are formed of a suitably strong and rigid plstic material, such as vinyl, which is extruded in the form of hollow members adapted to be cut to length as needed to provide the top, bottom and opposite side rail sections of each of the two sashes and of the master frame in which the sashes are fitted. By forming these extrusion of hollow configuration in transverse cross-section not only is the overall weight of the window reduced to a minimum but more importantly they provide in and of themselves internally confined thermal barriers of air which substantially increase the overall thermal insulating efficiency of the window.

Referring first to the construction of the external master frame 10 of the window which is designed to be fitted within an opening provided therefor in the wall of a building structure, it will be observed that it is formed of suitable lengths of the plastic extrusions of a uniform cross-section which are miter-jointed, as at 13, to provide a frame of the requisite rectangular shape and size required to accomodate therein a pair of the double hung suitably glazed window sashes 11 and 12. The extruded miter-jointed top, bottom and opposite side members of the external master frame 10, consisting of the heat $10^a$, the sill or stool $10^b$, and the opposite vertically extending side rails $10^c$ and $10^d$, are each of the same uniform transversely extending cross-section throughout the length thereof, the transverse configuration being generally that of the capital letter E, to provide therein a pair of side-by-side longitudinally extending channels $14^a$–$14^b$ which extend continuously about the full perimetral extent of the master frame 10.

These channels $14^a$–$14^b$ are provided with a double-walled main outer section 15 which forms between the two walls $15^a$ and $15^b$ thereof a plenum 16 in which the confined air serves as a thermal insulating barrier extending completely about the perimeter of the master frame in which are disposed the double-hung glazed sashes 11 and 12. Extending inwardly from the double-walled main outer section 15 of each of the E-shaped frame members $10^a$,$10^b$,$10^c$ and $10^d$ are the parallel inwardly projecting short branches 17, 18 19 which conjointly form the side enclosing walls of the side-by-side disposed channels $14^a$–$14^b$ formed in each of the E-shaped master frame members. The inwardly extending branch 17 which forms the exterior wall of the master frame 10 is also of hollow formation to provide a plenum 20 which is in communication with the plenum 16 of the hollow main section 15 of the frame so that in its miter-jointed fully assembled form the master frame 10 is provided about its entire perimeter with an L-shaped thermal barrier zone of air having a main portion which extends cross-wise of the window frame thickness about its full perimetral extent and an auxiliary portion which is disposed in a common plane paralleling the perimetrally continuous externally exposed outer flat surface of the master window frame 10.

The inwardly extending central branch 18 of the E-shaped frame members 10 constitutes the common dividing wall between the two channels $14^a$ and $14^b$, while the inwardly extending innermost branch 19 thereof forms that wall of the channel $14^b$ which faces the interior of the building structure in which the window is installed. It will be noted that since the innermost branch 19 of the E-shaped master frame members 10 is the part thereof which is exposed interiorly of the building structure in which the window is installed, there is no need for it to be of the double-walled thermal barrier construction as in the case of the exteriorly exposed branch 17 of the window frame member.

The intermediate branch 18 in each of the E-shaped frame members 10 is of a transverse cross-sectional thickness sufficient to provide therein a deep recess 21 for a purpose which will be described hereinafter. Also, it will be noted that the inwardly presenting branches 17, 18 and 19 of each of the master frame members 10 are provided at their free ends with inturned sections terminating in rabbeted extremities having bevelled end surfaces 22, each channel $14^a$ and $14^b$ being thus provided with a pair of such beveled surfaces 22 which present toward one another and define therebetween the open mouth of each channel. The function of these paired beveled surfaces as provided for each of the channels $14^a$ and $14^b$ will also be described hereinafter.

The glazed sashes 11 and 12 which are double-hung for movement relatively to one another in the master frame 10 constructed as above described are operatively balanced for their said vertical movement in closely adjoining paths by means of sash balances 23 respectively mounted in any conventional manner within the open-mouthed channels $14^a$ and $14^b$ provided in the vertically extending E-shaped sided members $10^a$ and $10^b$ each sash being thereby provided with a pair of such balances respectively disposed to either side of the sash. FIG. 9 illustrates one of such balance devices which may be used, made by Caldwell Mfg. Company, Rochester, New York, but since this balance forms no part of the present invention, it will be understood that any suitable balancing means may be employed for operation of the window constructed in accordance with the present invention.

The master frame 10 also includes as a structural part thereof a perimetrally complete parting strip arrangement which projects freely into the interior of the master frame opening to serve as a common guide and separating member between the vertically shiftable window sashes 11 and 12 fitted in the master frame opening. This parting strip arrangement includes a header supported member 24, a sill supported member 25 and a pair of spring-pressed members 26–26 respectively supported by the side rail sections $10^c$ and $10^d$ of the master frame.

As is best shown in FIG. 3, the header-supported parting strip member 24 and the sill supported parting strip member 25 are of identical construction, each having a main body portion 27 adapted for disposition flatwise along the width of the master frame window opening in overlying relation to the side-by-side channels $14^a$ and $14^b$ thereof whereby to close off the open ends of the latter. Formed as an integral element of the main body part 27 and extending along the full length thereof is an outwardly projecting spline member 28 which is centered between and parallels the longitudinal side edges of the window header, which spline is adapted to be frictionally secured within the recess 21 formed in the central branch 18 of the E-shaped header member $10^a$. Preferably, this frictional securement of the header-supported parting strip member 24 is effected by providing the free edge of the spline 28 with an enlargement 29 which may be snap-fitted into an accomodating groove 30 formed internally of the recess 21, as best appears in FIG. 3.

The main body portion 27 of the header-supported parting strip member is additionally integrally provided with an inwardly projecting end flange 31 to overlie the upper rail of the inside window sash 10, and with an inwardly projecting flange 32 centered between and paralleling the longitudinally extending side edges of the header. It is this latter flange 32 which serves as the sash parting strip between the double-hung window sashes at the top or header end of the master frame 10.

The sill-supported parting strip 25 is identical with that of the header-supported parting strip 24 and accordingly its several parts are respectively designated by the same numerals as have been employed to describe the header-supported parting strip. The only difference between the top and bottom parting strips is that they are physically reversed in position so that the operative parting strip portions 32 thereof are disposed in a common vertical plane intervening the paths of movement of the window sashes 11 and 12 with their free-edges presenting toward one another.

Figure 4:
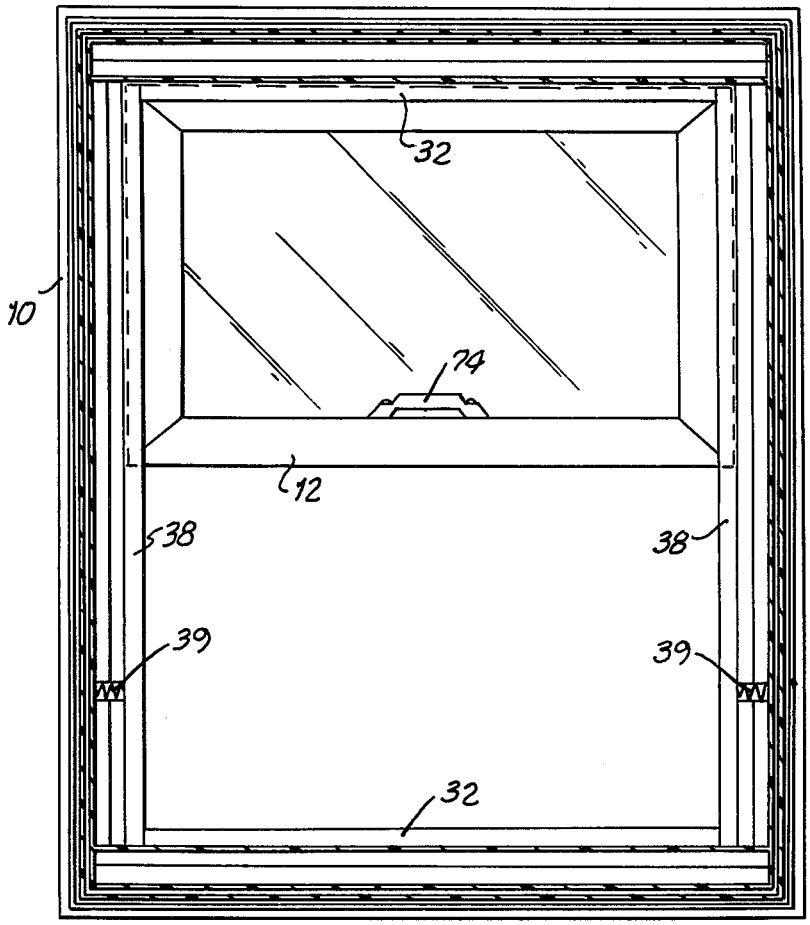
FIG. 4 is a view as taken along the line 4—4 of FIG. 2 showing the upper sash of the window in its raised position.

It will be noted, as best appears in FIG. 4, that the top and bottom parting strip sections (each designated 32) terminate short of the opposite ends of the members 27 of which they form an integral part and that these gaps are respectively filled by the ends of the vertically extending spring-pressed parting strip members 26—26 provided at either side of the master window frame 10. Also, as is best shown in FIG. 2, it will be observed that although these spring-pressed side parting strips 26—26 are each received in a recess 21 formed in the side members of the window frame 10 exactly the same as that formed in the header and sill members of the window frame for fixedly receiving therein the splines 28—28 of the top and bottom parting strip members 24 and 25, the side parting strip members are adapted to be edgewise bodily shifted into their recesses against the normal bias of their springs, thereby enabling the side parting strips to be shifted into position out of the way of the outside window sash 12 when it is desired to tilt the latter into position, as shown in FIG. 5, to clean the same.

Before proceeding further with the description of the construction and operation of these spring-pressed vertically extending parting strips 26—26, it will be noted that the master frame 10 is provided at the top and bottom ends of each of its vertically extending side rails $10^c$ and $10^d$ with a pair of stops 33 such as are best shown in FIG. 1, one pair of such stops being respectively located at opposite ends of the top end of the vertical path of movement of the inside window sash 11 to limit upward movement thereof and the other pair being respectively located at opposite ends of the bottom end of the path of movement of the outside window sash 12 to limit downward movement thereof. These stops 33 are each of the extruded construction shown in FIG. 6 to provide a main body portion 34 of channel-shaped cross-section having the free edges of its opposite side walls 35—35 terminating in sharply pointed uncinated edges, as at 36—36, so that it may be snap-fitted into secured position within the mouth of a channel ($14^a$ or $14^b$) formed in the side rails of the master frame. When snap-fitted into their respective positions, an opposed pair of these stops 33—33 are disposed at opposite ends of the run-way for the inside window sash 11 in adjoining relation to the inside section of the header-supported parting strip member 24, while a second opposed pair of these stops 33—33 are disposed at opposite ends of the runway for the outside window sash 12 in adjoining relation to the sill-supported parting strip member, as see FIG. 3.

Returning now to the hereinbefore mentioned vertically extending spring-pressed parting strips 26—26, it will be observed that each is in the form of an elongated flat blade-like member having a relatively thick inner portion 37 which snugly fits in the recess 21 provided therefor in the section 18 of the side rail of the master frame and with a thin portion outer portion 38 which normally projects out of the recess 21 under the biasing effort of a spring 39 which is contained in the recess and presses against the enclosed edge of the parting strip. Since the opposite ends of the parting strips 26—26 project beyond the free edges of the header-supported parting strip member 24 and the sill-supporting parting strip member 25, these last-mentioned members serve to limit outward movement of the vertically extending spring-pressed parting strips and conjointly with the latter form a perimetrally complete parting strip between the two vertically movable window sashes 11 and 12. However, when it is desired to tilt the window sashes outwardly of the master frame into their positions shown in FIG. 5, the side parting strips 26—26 may be pushed back against the bias of the springs 39—39 into their accomodating recesses 21—21 wherein they are each held automatically in their retracted position by the spring-pressed detents 40 carried by each of the opposed bottom stops 33 for the inside window sash 11. It will be noted that automatically as the parting strip member is pressed into its accomodating recess, the detent 40 pops out across the free edge of the parting strip to hold the same in its fully retracted position.

In respect to the construction of the window sashes 11 and 12, reference is made more particularly to FIGS. 2 and 3 wherein it will be observed that as in the case of the master frame 10 the double hung set of the glazed window sashes 11 and 12 are each formed of top, bottom and side rails respectively designated $11^a$,$11^b$,$11^c$ and $11^d$ which are extruded of vinyl or other suitably rigid and strong plastic or other material and cut to their requisite lengths. Since both the bottom or inside window sash 11 and the top or outside window sash 12 are of the same construction and size and thus are interchangeable for use as either the inside or the outside sash, only one of them will be described in detail and similar parts thereof have been designated by like reference numerals. The extruded top, bottom and side rails are miterjointed at the corners of the sashes, as at 41.

As is best shown in FIGS. 2 and 3, the top, bottom and side rail extrusions of which each of the double-hung sashes is formed is of a uniform transverse cross-section throughout its full length, each extrusion having a main wall part 42 from which externally projects a pair of laterally spaced flanges 43 and 44 having their longitudinal edges respectively formed to provide the same with a pair of inwardly presenting projections 45—45 which define therebetween a transversely restricted open mouth 46 of a shallow channel 47 facing outwardly of the wall part 42. Also formed as an integral part of the extruded window sash rail is an inwardly presenting channel 48 which faces inwardly of the main wall part 42, which channel 48 is provided with a bottom wall 49 and opposite side walls 50—50 disposed in spaced relation respectively to the wall part 42 and a pair of parallel side walls 51—51 projecting inwardly of the main wall part 42. The channel 48 is of a width sufficient to accomodate therein a pair of laterally spaced panes 52—52 of window glass having the space therebetween suitably hermetically sealed, as at 53.

When the window sash rails $10^a$,$10^b$,$10^c$ and $10^d$ are assembled in their double glazed condition as shown, it will be observed that not only is there provided a thermal barrier of air between the glass panels 52—52, but also the channels 48 which receive the glass panels and extend continuously about the full perimeter of the window sash are themselves perimetrally thermalloy insulated by the air confined within the space 54 between the channel 48 and its surrounding supporting structure. It will of course be understood that the internal channels 48 of the window sash may be sized to accomodate, if desired, a single pane of glass.

Held captive within each external channel 47 of the vertically extending window sash rails $11^c$ and $11^d$ is a longitudinally extending hollow extruded member 55 having spaced wall parts 56 and 57, and oppositely extending coplanar side flanges 58—58. The outwardly presenting wall part 56 has oppositely disposed beveled surfaces 59—59 forming a beveled edge nose part adapted to seat against and slidably ride along the complementally beveled surfaces 22–27 of the master frame channels $14^a$—$14^b$ as the sash is raised and lowered. These hollow members 55 are each outwardly biased from their accomodating channels 47—47 by an elongated leaf spring 60 which is interposed between the proximate transversely extending wall parts of each of the sash rails $10^c$ and $10^d$ and the outwardly biased members 55—55 respectively carried thereby, as see FIGS. 2 and 9. The biasing leaf springs 59 are each suitably secured, as by a screw 61, to the main wall part 42 of each vertically extending side rail of the window sash with its free end disposed to bear against the central region of the spring-pressed hollow member 55. The oppositely extending side flanges 58—58 of this member 55 limit complete outward displacement thereof from within its accomodating channel 47 in the window sash side rail, while at the same time that said member extends across the full width of the mouth of said member.

The bottom rails $11^b$ of both the inside and outside window sashes have secured thereto at each side end thereof, of which one is best shown in FIG. 9, an adjustably positioned elongated member 62, secured to the rail by the screws 63, having an end thereof which freely projects beyond the side of the sash for engagement with a rotatable member 64 provided in the bottom end of the sash balance 23. There is thus provided at the bottom side ends of both the inside and the outside window sashes pivot means designed to permit inward tilting of the sashes from within the master frame, as is best illustrated in FIG. 5.

The upper or top rails $11^a$ of each of the inside and outside window sash are provided at each side thereof with a latch device 65, best shown in perspective in FIG. 8, having a main body member 66 which is undercut, as at 67, to provide a slot for a rectilinearly shiftable latching element 68 having a finger-receiving opening 69 therein for actuation thereof, this opening being accessible through an elongated opening 70 provided in the top of the member 66. The shiftable latching element 68 is preferably spring-pressed by an internal spring not shown and is provided at its outer free end with an angled extremity 71 having a beveled camming edge 72 angularly related to a straight edge 73 of the shiftable latch element. When it is desired to outwardly swing the window sash fitted with these latch devices from its normal upright position, the two latches at the upper end thereof are shifted inwardly toward each other to free the normally outwardly projecting ends of the latch elements 68—68 from their engagement with the outwardly projecting edges of the side rails $10^a$ and $10^d$ of the master frame 10. To re-position the window sashes in their normal vertical shiftable positions, it is merely necessary to swing the same inwardly to automatically cam the latching elements 68—68 inwardly of their support members 66—66 whereupon they are spring-pressed outwardly to re-engage the master frame as shown in FIG. 8. It will be understood that any other suitable latching devices may be employed in lieu of those shown and described.

The double-hung window sashes may be locked together in their normally closed positions by any suitable locking device having coacting parts respectively attached to the meeting rails of the two sashes, as for example, by suitably slotted lock elements 74 and 75 respectively fixedly secured to the top rail $11^a$ of the inside window sash and the bottom rail $11^b$ of the outside window sash adapted to be interconnected by a swingable element 76 which commonly projects through the fixed elements 74 and 75 when the slots of the latter are brought into registry with one another. The inside window sash is suitably provided with a lifting handle 77.

The upwardly presenting open-topped channels 47 in the top rails $11^a$ of each window sash are each closed by closure plates 78 having downwardly projecting laterally spaced flanges 79 the longitudinally extending free edges of which are uncinated, as at 80, for snap-fitting engagement with the upwardly projecting side wall parts 43–44 of said channels. These top closure plates 78, as best shown in FIG. 2, have secured thereto, as by the screws 81, the hereinbefore mentioned latching devices 65—65.

It will be noted that provision is made to weatherproof and seal off all of the air spaces between the window sashes 11 and 12 themselves as well as between each of said sashes and the master frame of the window when the window sashes are in their fully closed position as shown in FIG. 2. For this purpose, each of the rail elements $11^a$,$11^b$,$11^c$ and $11^d$ which make up the glazed window sashes is provided on its exteriorly presenting face with an integrally formed channel 82 for fixedly receiving in each such channel a weather-stripping element 83 having wool fibers or like projecting out of the channel for wiping engagement with an apposed surface of an adjoining part of the window structure. Thus, as shown in FIG. 2, the inside window sash 12 is provided along each of its vertically extending side rails with substantially coextensive lengths of the weatherstripping elements 83 which are compressed against the flat surfaces of the vertically extending spring-pressed parting strips 26—26 upon the normal closing of said window sash, while the outside sash 12 is similarly provided along each of its vertically extending rails with lengths of the weatherstripping elements 83 which engage the flat surfaces of the vertically extending exterior side flanges 84 of the master frame which overlie the exterior faces of the outside window sash.

It will be observed that the flanged parts 84 of the master window frame 10 are formed as integral extensions of the top, bottom and side rail sections $10^a$,$10^b$,$10^c$ and $10^d$ on the exterior sides thereof and conjointly provide the master frame 10 with a perimetrally continuous outer part which forms the external wall of the runway in which the outside window sash is vertically shiftable. If desired, these flanged parts 84 may be augmented with integral formed L-shaped extensions 85 thereof to provide on the exterior side of the frame a perimetrally continuous channel 86 within which may be accomodated a screen (not shown).

With the window sashes in their closed positions, as shown in FIG. 2, the weatherstripping elements 83 which extend along the top and bottom rails of the inside window sash 11 respectively seal closed the air gaps between the meeting horizontal rails of the closed windows and between the bottom rail of said inside sash and the fixed parting strip member 32 formed as an integral part of the sill-supported member 25, while the weatherstripping element which extends along the top rail of the outside window sash 12 seals off the air space between the top of the sash and the flat surface of the horizontally extending flanged interior part 84 of the master frame which overlies the outer face of the outside window sash.

Additional weatherstripping of the window sashes when in their closed condition is preferably provided by weatherstripping elements 83 seated in lipped horizontally extending retaining channels 87 formed in the opposed end flanges 31 of the horizontally disposed header-supported and sill-supported parting strip-forming members 24 and 25, as is most clearly shown in FIG. 3.

In operation of the window constructed in accordance with the present invention, it will be observed that for normal vertically shiftable movement of the window sashes 11 and 12 within the master frame 10, the opposite sides of each sash are guided during vertical movement thereof by the sliding fit of the beveled edge nose part 56 of the spring-pressed side members 55 held captive in the vertical sides of the sash within the fixed bevel-edged open mouths of the inwardly presenting of the channels 14$^a$ and 14$^b$ provided in opposite sides of the master frame of the window. It will be noted in this connection that as the beveled surfaces 59—59 of each said spring-pressed member 55 respectively engage and ride along the complementally bevelled end surfaces of the channels 14 of the master frame, the interengaged beveled surfaces resiliently hold the sashes against unintended displacement from the normal paths of vertical movement and yet provide a weather tight seal between the vertically extending sides of the sashes and the adjoining side rails of the master window frame.

The window sashes 11 and 12 are additionally held in their respective paths of vertical movement during normal operation of the window by the engagement of the top-side latches 68 with the vertical rails of the master frame (as see FIG. 8) along which these latches ride as the sashes are vertically raised and lowered. Also, since the sash balance pivots provided for each window sash at the bottom ends thereof are constrained to move rectilinearly along vertical lines coincident with the vertical paths of movement of the sashes, these sash balance pivots coact with the aforementioned latches 68 to insure undeviating vertical movement of the sashes during the normal operation.

When it is desired to tilt one or both of the window sashes interiorly of the window frame into their positions shown in FIG. 5, it is merely necessary in the case of the inside sash 11 to raise it free of the sill member 10$^b$ of the window frame and then retract the latches 68—68 at the top end of the sash from their engagement with the master frame side rails 10$^c$ and 10$^d$, as see FIG. 8, whereupon the inside sash may be tilted out of the window frame about the sash balance pivot members 64 provided at either side of the sash at the bottom end thereof.

The same procedure is followed with respect to the outside sash, except that in the case of this outside sash 12 it is necessary prior to retraction of its latches 68—68 from engagement with the side rails 10$^c$ and 10$^d$ of the window frame to first lower the sash to free the top end thereof from the header 10$^a$ of the window frame and then outwardly press the vertically extending parting strips 26—26 against the biasing effort of their springs 38—39 to permit inward tilting of the outside sash about its sash balance pivots members 64. In order to prevent interference against such inward tilting of the outside sash by the inwardly tilted inside sash, the stop members 33—33 provided at opposite sides of the bottom end of the master window frame 10 are each of a vertical length sufficient to limit downward shifting of the outside sash to a level at which its pivot points are spaced vertically above the pivot points of the inwardly tilted inside window sash 11.

It will be apparent that as the sashes are each inwardly tilted about their pivot points, the beveled edge nose parts 56—56 of the spring-pressed members 55—55 respectively held captive in the vertically extending side rails of each window sash are urged inwardly against the bias of their leaf springs 60 as the innermost beveled edges of said nose parts move angularly across their respectively engaging beveled surfaces of the master frame side rails 10$^c$ and 10$^d$.

In order to return the inwardly tilted sashes 11 and 12 into their normal double-hung condition as shown in FIGS. 1 to 3, it is only necessary to swing these sashes about their respective pivots 64—64 into their vertically extending positions whereupon the latches 68—68 at the opposite sides of their top ends are cammed into their retracted positions and then automatically spring out to re-engage the side rail members of the master window frame 10 to hold the window sashes in their normal double-hung condition and at the same time return the spring-pressed members 55—55 into weather-sealed engagement with the side rails of the master frame.

It will be understood that the window construction of the present invention is susceptible of various changes and modifications which may be made from time to time without departing from the general principles or real spirit thereof. Thus, although the window has been described as being formed of plastic material, such as vinyl, which is preferable because of its lightness in weight, durability and other advantageous properties, it may be formed of extrusions of metal, such as aluminum, or of any other metal parts stamped, rolled or assembled to provide the structural elements which form the window frame and its glazed sashes. Accordongly it is intended to claim the invention broadly, as well as specifically, as indicated in the appended claims.

What is claimed as new and useful is:

1. In a window construction of the character described, in combination, a master frame having a window opening adapted to accommodate therein a pair of double-hung window sashes of identically the same size and shape, said master frame being provided in the vertically extending sides thereof with oppositely disposed spring-loaded parting strip elements which are normally biased into positions intervening the proximate sides of said double-hung window sashes, said parting strip elements being adapted to be oppositely pressed into said sides of said master frame whereby to permit successive inward tilting of the inside and outside window sashes when the latter are respectively raised and lowered within said master window frame, and means for automatically holding said spring-loaded parting strip elements respectively in their outwardly pressed positions to provide clearance for inward swinging movement of the outside window sash about a pivotal axis closely paralleling the bottom end of said lowered outside window sash.

2. In a window construction as defined in claim 1 wherein each of said window sashes is provided on opposite stiles thereof with vertically extending spring-loaded weatherstripping members which are respectively outwardly biased from each stile of each sash for resilient weather-tight engagement with a proximate side of said master frame and with means for permitting said sashes to be tilted inwardly of said master frame about pivotal axes closely paralleling the bottom ends of said sashes, said spring-loaded weather-stripping members being operative upon said inward tilting of the window sashes to angularly wipe across the sides of said master frame against the normal outward biasing effort of said weather-stripping members.

3. In a window construction as defined in claim 2 wherein said master frame is provided in opposite sides thereof with vertically extending relatively fixed runways for movement of said sashes within said master frame, said spring-loaded weather-stripping members being operative upon said inward tilting of the window sashes to ride out of and wipe across the inside edges of their respective runways against the normal biasing effort of said weather-stripping members, said last-mentioned means including retractible latches which are operative when retracted to free the window sashes for said inward tilting thereof and when released to automatically hold the sashes in position for vertical movement thereof in said runways.

4. In a window construction as defined in claim 1 wherein said spring-loaded parting strip elements are supplemented by intervening coplanar relatively fixed parting strip elements extending horizontally along the top and bottom members of said master window frame.

5. In a window construction as defined in claim 4 wherein said relatively fixed parting strip elements respectively extend across the space between the corresponding ends of said spring-loaded parting strip elements when the latter are in their said normally biased positions intervening the double-hung vertically movable window sashes whereby to limit inward projection of said spring-loaded parting strip elements and to provide conjointly with the latter a coplanar assembly of parting strip elements which extends continuously about the full perimeter of the window opening of said master frame.

6. In a window construction as defined in claim 2 wherein said spring-loaded weather-stripping members are held captive in opposite stiles of each of said window sashes for free-floating weather-tight engagement with the proximate sides of said master frame and wherein said spring-loaded weather-stripping members are each of a hollow configuration in transverse cross-section to provide therein a plenum of confined air which serves as a thermal insulating barrier.

7. In a window construction as defined in claim 1 wherein said master frame is provided with top, bottom and side rail members each including a pair of side-by-side channels having their longitudinally extending open mouths presenting inwardly and substantially continuously about the full perimeter of said frame, wherein said channels are separated from one another by a common wall part having formed therein an open-ended recess which presents inwardly toward the interior of the frame and extends about the full perimeter of the window opening in a common vertical plane disposed between the paths of relative movement of said window sashes, and wherein the recesses in said side rail members of said frame are each fitted with one of said spring-loaded parting strip members shiftable one of said spring-loaded parting strip members shiftable in the plane of said recess into and out of a position intervening the proximate side rail parts of said double-hung window sashes.

8. In a window construction as defined in claim 1 wherein said master frame includes a pair of opposed vertically extending side rails the main body portions of which are of generally E-shaped configuration in transverse cross-section to thereby provide in each said side rail a pair of side-by-side channels separated by a common central wall for respectively accommodating for vertical movement therein the proximate corresponding stiles of said double-hung window sashes, said central wall being recessed to operatively receive therein one of said spring-loaded parting strip elements.

9. In a window construction as defined in claim 8 wherein the top and bottom rails of said master frame are formed of the same transverse cross-section as that of said side rails and wherein said top and bottom rails each have stationarily fitted in said central wall thereof a member having an integral positionally fixed supplemental parting strip disposed in intervening relation between and in the plane of said oppositely disposed spring-pressed parting strip elements.

10. In a window construction as defined in claim 8 wherein said double-hung sashes are respectively supported for swinging movement inwardly of said master frame by pivot means slidable in the vertically extending channels in the sides of said frame and having their pivotal axes extending along a line substantially coincident with the bottom ends of said sashes whereby upon movement of said sashes out of their normally closed positions they may be swung about their respective pivotal axes inwardly of said master frame.

* * * * *